US010690433B2

(12) United States Patent
Oliver

(10) Patent No.: US 10,690,433 B2
(45) Date of Patent: Jun. 23, 2020

(54) ENERGY CAPTURE AND CONTROL DEVICE

(71) Applicant: OSS Suppressors LLC, Millcreek, UT (US)

(72) Inventor: Russell Oliver, Millcreek, UT (US)

(73) Assignee: OSS Suppressors LLC, Millcreek, UT (US)

( * ) Notice: Subject to any disclaimer, the term of this patent is extended or adjusted under 35 U.S.C. 154(b) by 0 days.

(21) Appl. No.: 16/690,720

(22) Filed: Nov. 21, 2019

(65) Prior Publication Data

US 2020/0103194 A1 Apr. 2, 2020

Related U.S. Application Data

(63) Continuation of application No. 14/326,152, filed on Jul. 8, 2014, now abandoned, which is a continuation of application No. 13/025,941, filed on Feb. 11, 2011, now Pat. No. 8,790,434.

(60) Provisional application No. 61/303,553, filed on Feb. 11, 2010.

(51) Int. Cl.
*F41A 21/30* (2006.01)
*F41A 21/32* (2006.01)

(52) U.S. Cl.
CPC ..... *F41A 21/30* (2013.01); *F41A 21/32* (2013.01)

(58) Field of Classification Search
CPC ..... F41A 21/30; F41A 21/32; F01N 1/003; F01N 1/084; F01N 1/10; F01N 1/12; F01N 1/125
See application file for complete search history.

(56) References Cited

U.S. PATENT DOCUMENTS

| | | | | |
|---|---|---|---|---|
| 748,157 A | | 12/1903 | Bouton | |
| 822,127 A | | 5/1906 | Hufnagel | |
| 916,885 A | | 3/1909 | Maxim | |
| 1,341,363 A | | 5/1920 | Fiala | |
| 1,427,802 A | | 9/1922 | Goodwin | |
| 1,462,158 A | | 7/1923 | Wildner | |
| 1,605,864 A | * | 11/1926 | Steinegger | F41A 21/30 89/14.3 |

(Continued)

FOREIGN PATENT DOCUMENTS

| | | |
|---|---|---|
| GB | 743111 A | 11/1956 |
| GB | 2287780 A | 9/1995 |

(Continued)

OTHER PUBLICATIONS

"3.5 MSS (Modular Suppressor System)—(Barrel Extension) by JBU—Airsoft Guns | Trinity Airsoft". Web. Apr. 7, 2011. http://www.trinityairsoft.com/p-1451-35-mss-modular-suppressor-system-barrel-extension-by-jbu.aspx.

(Continued)

*Primary Examiner* — Robert Clemente
(74) *Attorney, Agent, or Firm* — Thorpe North & Western, LLP

(57) ABSTRACT

An energy capture and control device can include a central chamber oriented along a central axis within an outer shell. The central chamber can have an inlet configured to receive a bullet from a firearm muzzle, and a central chamber outlet along the central axis. The device can also include an off axis chamber oriented within the outer shell in fluid communication with the central chamber and a fluid outlet to allow fluid to escape from the off axis chamber.

24 Claims, 13 Drawing Sheets

(56) References Cited

U.S. PATENT DOCUMENTS

| | | | |
|---|---|---|---|
| 1,736,319 | A | 11/1929 | Maxim |
| 1,773,443 | A | 8/1930 | Wilman |
| 2,165,457 | A | 7/1939 | Cutts, Jr. |
| 2,514,996 | A | 7/1950 | Faust, Jr. |
| 3,187,633 | A | 6/1965 | Tanabe |
| 3,581,573 | A | 6/1971 | Purcell et al. |
| 3,667,570 | A | 6/1972 | Werbell, III |
| 3,693,750 | A | 9/1972 | Takkunen |
| 3,698,747 | A | 10/1972 | Wing et al. |
| 4,058,925 | A | 11/1977 | Linde et al. |
| 4,454,798 | A | 6/1984 | Shea et al. |
| 4,482,027 | A | 11/1984 | Gould |
| 4,501,189 | A | 2/1985 | Brandl et al. |
| 4,510,843 | A | 4/1985 | Rabatin |
| 4,530,417 | A | 7/1985 | Daniel |
| 4,576,083 | A | 3/1986 | Seberger, Jr. |
| 4,907,488 | A | 3/1990 | Seberger |
| 4,974,489 | A | 12/1990 | Fishbaugh |
| 5,010,676 | A | 4/1991 | Kennedy |
| 5,029,512 | A | 7/1991 | Latka |
| 5,036,747 | A | 8/1991 | McClain, III |
| 5,078,043 | A | 1/1992 | Stephens |
| 5,164,535 | A | 11/1992 | Leasure |
| 5,433,133 | A | 7/1995 | La France |
| 5,486,425 | A | 1/1996 | Seibert |
| 5,590,484 | A | 1/1997 | Mooney et al. |
| 5,656,166 | A | 8/1997 | Lirmersten et al. |
| 5,661,255 | A | 8/1997 | Webb, III |
| 5,679,916 | A | 10/1997 | Weichert |
| 5,698,810 | A | 12/1997 | Rose |
| 5,777,258 | A | 7/1998 | Soon |
| 5,860,242 | A | 1/1999 | O'Neil |
| 5,952,625 | A | 9/1999 | Huff |
| 6,079,311 | A | 6/2000 | O'Quinn et al. |
| 6,298,764 | B1 | 10/2001 | Sherman et al. |
| 6,302,009 | B1 | 10/2001 | O'Quinn et al. |
| 6,308,609 | B1 | 10/2001 | Davies |
| 6,374,718 | B1 | 4/2002 | Rescigno et al. |
| 6,376,565 | B1 | 4/2002 | Dyer et al. |
| 6,425,310 | B1 | 7/2002 | Champion |
| 6,490,822 | B1 | 12/2002 | Swan |
| 6,499,245 | B1 | 12/2002 | Swan |
| 6,575,074 | B1 | 6/2003 | Gaddini |
| 6,732,628 | B1 | 5/2004 | Coburn et al. |
| 6,792,711 | B2 | 9/2004 | Battaglia |
| 6,796,214 | B2 | 9/2004 | Hausken et al. |
| 6,959,509 | B2 | 11/2005 | Vais |
| 7,000,547 | B2 | 2/2006 | Amick |
| 7,036,259 | B2 | 5/2006 | Beretta |
| 7,059,233 | B2 | 6/2006 | Amick |
| 7,059,235 | B2 | 6/2006 | Hanslick et al. |
| 7,131,228 | B2 | 11/2006 | Hochstrate et al. |
| 7,207,258 | B1 | 4/2007 | Scanlon |
| 7,216,451 | B1 | 5/2007 | Troy |
| 7,237,467 | B1 | 7/2007 | Melton |
| 7,308,967 | B1 | 12/2007 | Hoel |
| 7,325,474 | B2 | 2/2008 | Yoshimura et al. |
| 7,353,740 | B1 | 4/2008 | Hoffman |
| 7,353,741 | B2 | 4/2008 | Brixius |
| 7,412,917 | B2 | 8/2008 | Vais |
| 7,587,969 | B2 | 9/2009 | Silvers |
| 7,610,710 | B2 | 11/2009 | Brittingham |
| 7,661,349 | B1 | 2/2010 | Brittingham |
| 7,676,976 | B2 | 3/2010 | Dueck et al. |
| 7,707,762 | B1 | 5/2010 | Swan |
| 7,823,314 | B1 | 11/2010 | Wheatley |
| 7,891,282 | B1 | 2/2011 | DeGroat |
| 7,905,319 | B2 | 3/2011 | Sullivan |
| 7,987,944 | B1 | 8/2011 | Brittingham et al. |
| 8,087,338 | B1 | 1/2012 | Hines |
| 8,096,222 | B2 | 1/2012 | Silvers |
| 8,100,224 | B1 | 1/2012 | Olson |
| 8,196,701 | B1 | 6/2012 | Oliver |
| 8,286,750 | B1 | 10/2012 | Oliver |
| 8,516,941 | B1 | 8/2013 | Oliver |
| 8,790,434 | B1 | 6/2014 | Oliver |
| 2003/0145718 | A1 | 8/2003 | Hausken et al. |
| 2007/0107982 | A1 | 5/2007 | Sullivan |
| 2007/0256347 | A1 | 11/2007 | Fitzpatrick et al. |
| 2009/0235568 | A1 | 9/2009 | Auvine |
| 2010/0048752 | A1 | 2/2010 | Vignola et al. |
| 2010/0199834 | A1 | 8/2010 | Dueck et al. |
| 2010/0275492 | A1 | 11/2010 | Moller |
| 2011/0036233 | A1 | 2/2011 | DeGroat |
| 2012/0048100 | A1 | 3/2012 | Davies |

FOREIGN PATENT DOCUMENTS

| | | |
|---|---|---|
| GB | 2288007 A | 10/1995 |
| WO | WO 9407103 | 3/1994 |
| WO | WO 99/02826 | 1/1999 |

OTHER PUBLICATIONS

"JBU 6.5 inch Modular Silencer and Flash Hider System". Web. Apr. 6, 2011. http://www.airsoftatlanta.com/JBU_6_5_inch_Modular_Silencer_and_Flash_Hider_p/52319.htm.

Wikipedia, Suppressor, http://en.wikipedia.org/wiki/Suppressor, Retrieved Jan. 26, 2010, pp. 1-14.

* cited by examiner

ENERGY CAPTURE AND CONTROL DEVICE

RELATED APPLICATIONS

This application is a continuation of U.S. patent application Ser. No. 14/326,152, filed Jul. 8, 2014, which is a continuation of U.S. patent application Ser. No. 13/025,941, filed Feb. 11, 2011, which claims priority to U.S. Provisional Patent Application No. 61/303,553, filed on Feb. 11, 2010, which are each incorporated herein by reference.

BACKGROUND

High energy sources can produce undesirable levels of acoustic noise and/or particulate pollution. Frequent exposure to high levels of acoustic noise can cause permanent or temporary hearing loss. Furthermore, in the case of firearms discharge, such acoustic noise can also provide information as to location of a shooter. In the field of firearm sound suppression, basic sound suppression and particulate capture technology has varied only modestly over the past hundred years. Generally, these designs are based on internal baffles which direct gases into vortices or other flow patterns with optional expansion chambers. Although these designs provide suppression of sound from firearm discharge, there is still a substantial decibel level produced when using these devices. Furthermore, such devices have only limited usefulness in particulate capture. In certain applications, such as sniper rifles, discharged particulates can reveal a location of a shooter. In addition, discharged particulates can obstruct a shooter's vision of a target, particularly at long ranges, and can even be blown back into the shooter's face. Additionally, when using suppressors, there is a volume of oxygen which is present within the suppressor. An initial discharge of a suppressed firearm will ignite this oxygen and cause what is referred to as a "first round flash." Such flash can enable others to pinpoint the location of the shooter.

Some particulates are carried in gases which are directed into the internal baffles described. Suppression designs which reduce sounds and particulate discharge to a higher degree also tend to have a lower useful lifespan. Many current high-end designs utilize a sound absorbing fluid such as oil or water in the device. Such fluids must be periodically replaced (e.g. every few shots) and can be vaporized and distributed into the air upon discharge of the firearm. Therefore, despite some advantageous performance of these devices, many challenges still remain in achieving a long service life suppressor with low maintenance requirements and high particulate capture performance.

SUMMARY

The technology provides for particulate capture from a high energy discharge device. Capturing particulates can prevent or reduce debris from being discharged, improve visibility, and can suppress or eliminate first round flash. In anti-terrorism operations, concealment of the location of firearm operators is critical to hostage rescue, terrorist apprehension, operations protection, dignitary and witness protection, and intelligence gathering operations. These missions are critical to the successful defense of nations from terrorism. Particulate capture devices for firearms can dramatically increase effectiveness and survivability of counter terrorism special forces during such operations. Increased survivability in such scenarios can improve operator performance and decrease collateral costs associated with injuries to highly trained operators.

An energy capture and control device can include a central chamber oriented along a central axis within an outer shell. The central chamber can have an inlet configured to receive a bullet from a firearm muzzle, and a central chamber outlet along the central axis. The device can also include an off axis chamber oriented within the outer shell in fluid communication with the central chamber and a fluid outlet to allow fluid to escape from the off axis chamber.

Figure 1A:
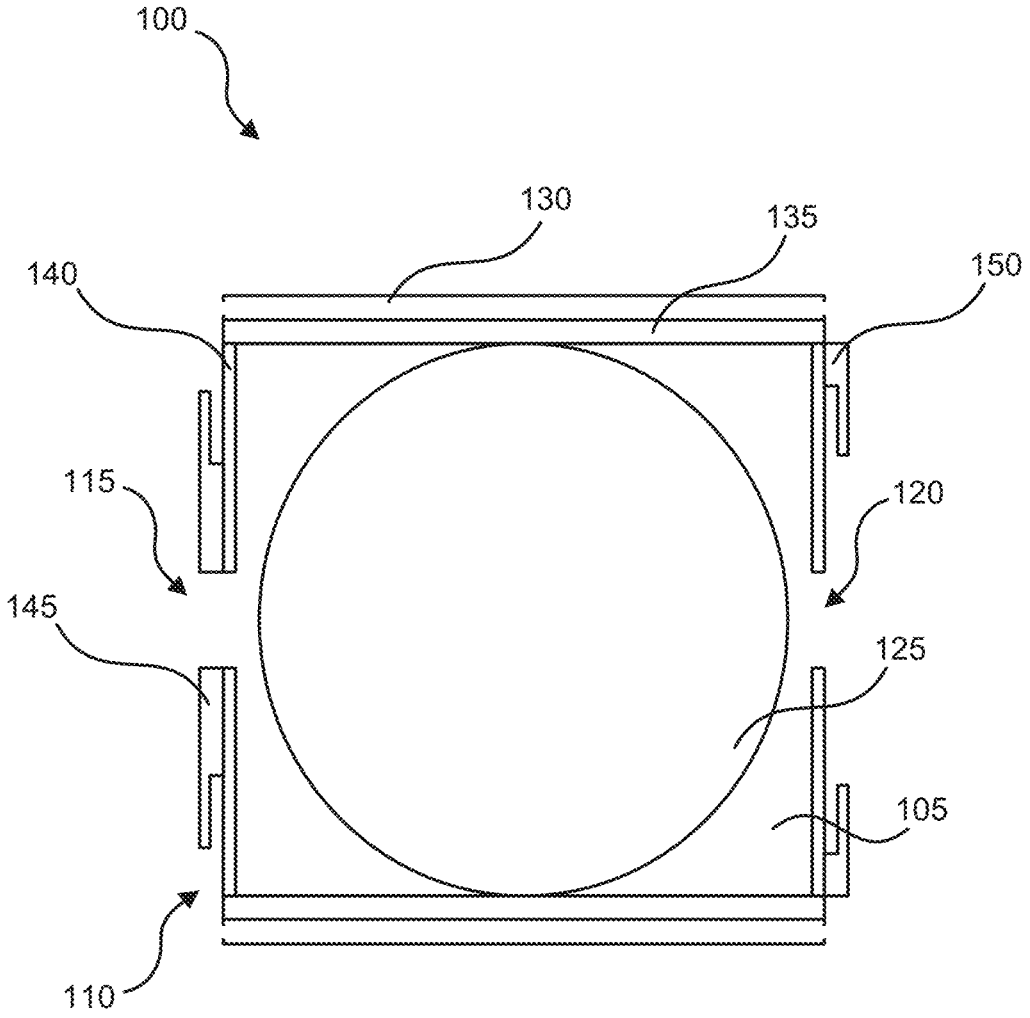
FIGS. 1*a*-1*c* are cross-sectional side views of particulate capture modules in accordance with examples of the present technology.

These figures are provided for convenience in describing the following aspects. In particular, variation may be had in dimensions, materials, configurations and proportions from those illustrated and not depart from the scope of the invention.

DETAILED DESCRIPTION

While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

Definitions

In describing and claiming the present invention, the following terminology will be used.

The singular forms "a," "an," and "the" include plural referents unless the context clearly dictates otherwise. Thus, for example, reference to "a tube" includes reference to one or more of such members, and reference to "directing" refers to one or more such steps.

As used herein with respect to an identified property or circumstance, "substantially" refers to a degree of deviation that is sufficiently small so as to not measurably detract from the identified property or circumstance. The exact degree of deviation allowable may in some cases depend on the specific context.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of about 1 to about 4.5 should be interpreted to include not only the explicitly recited limits of about 1 to about 4.5, but also to include individual numerals such as 2, 3, 4, and sub-ranges such as 1 to 3, 2 to 4, etc. The same principle applies to ranges reciting only one numerical value, such as "less than about 4.5," which should be interpreted to include all of the above-recited values and ranges. Further, such an interpretation should apply regardless of the breadth of the range or the characteristic being described.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

Particulate Capture and Control

Figure 1B:
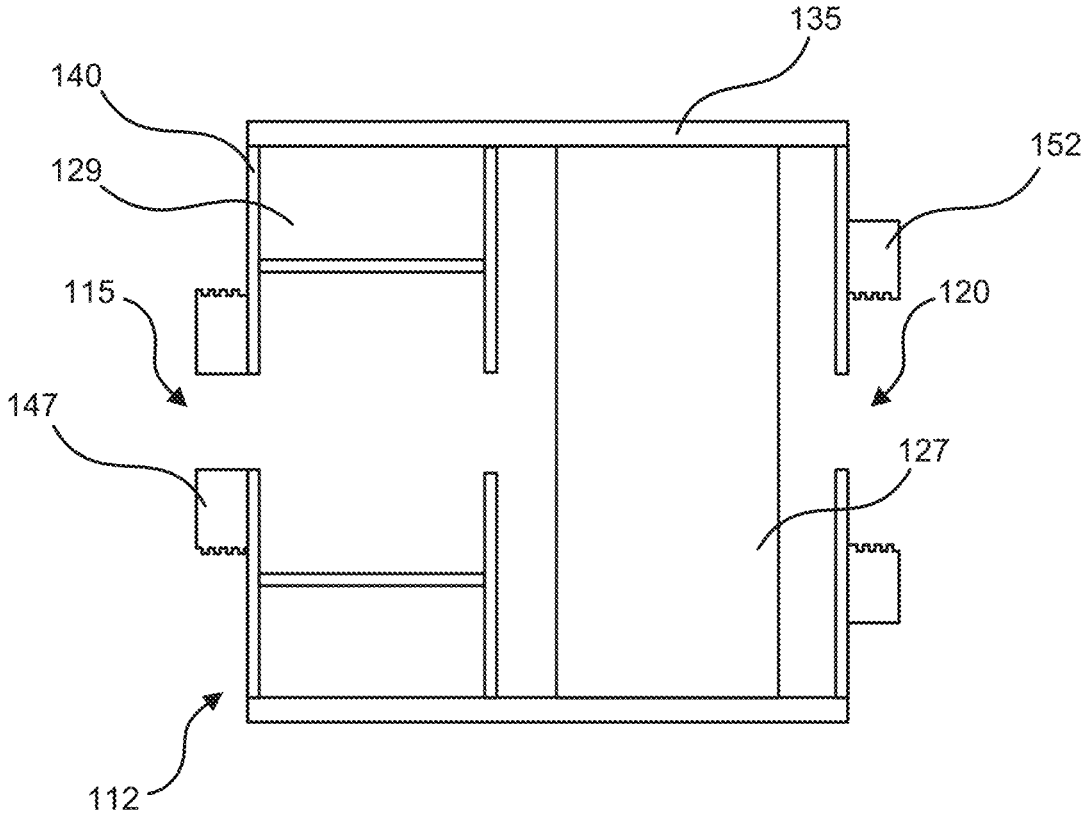

A particulate capture module 100 for a high energy discharge device is shown in FIGS. 1*a*-1*b* in accordance with examples of the present technology. The particulate capture module includes a particulate capture shell 110 having an inlet 115 and an outlet 120. The shell inlet can receive a high energy material discharged from the high energy discharge device. The particulate capture module can further include a self-healing particulate capture material 125 arranged within a chamber 105 of the particulate capture shell to enable the high energy material to pass through the self-healing particulate capture material. The self-healing particulate capture material can capture particulates associated with discharge of the high energy material from the high energy discharge device by sealing a puncture in the self-healing material after the high energy material has passed through. The particulates can be captured within the particulate capture module because the self-healing material has healed and an exit for the particulates has closed.

The particulate capture module 100 can be a removable modular attachment that can be used to capture particulates from the high energy material as the particulates exit the module. The particulate capture module can be particularly useful in firearm applications where the high energy material is a bullet and the high energy discharge device is a firearm. For example, the inlet 115 and outlet 120 can be aligned along a bullet path upon exit from a firearm barrel. Although impact with the self-healing particulate capture material 125 will affect bullet ballistics such impact can be minimized by careful selection of the material composition and allowance for material deformation around the bullet as it passes through the material. The particulate capture module can be used in other applications as well such as, but not limited to, pistols, rifles, machineguns, sub-machineguns, crew serve weapon platforms mounted and dismounted, ground air or sea based artillery and the like. Calibers can range generally from 5 mm to 40 mm diameter projectiles. The modular attachment can be configured to attach to the fluid outlet of a high energy discharge device to remove particulates associated with discharge of the high energy material from the high energy discharge device.

The shell 110 and/or internal walls of the particulate capture module can be formed of a material which is sufficiently strong to withstand energy, sounds, gases, and so forth from the high energy material. For example, the shell and/or walls can be made substantially of titanium. Non-limiting examples of other suitable materials can include high impact polymers, stainless steels, aluminum, molybdenum, refractory metals, super alloys, aircraft alloys, carbon steels, carbides, composites thereof, and the like. One or more of the individual components can further include optional coatings such as, but not limited to, diamond coatings, diamond-like carbon coatings, refractory metals such as molybdenum, tungsten, tantalum, carbides thereof, and the like can also be used. These components can be molded, machined, deposited or formed in any suitable manner. Currently, machining can be particularly desirable but is not required.

Referring to FIG. 1*a*, the particulate capture module 100 can have flow orifices which can be aligned with flow orifices in the high energy discharge device. Some firearms, silencers, or other firearm attachments can have a fluid outlet for releasing gases, pressure, and the like when the firearm is fired. The particulate capture module can include a fluid flow path 130 for fluids received through the flow orifices to enable discharge of the fluids through an end of the particulate capture module. The fluid flow paths can optionally be fluidly isolated from a chamber 105 within the particulate capture shell 110 in which the particulate capture material 125 is arranged.

As described above, the particulate capture module includes a self-healing particulate capture material 125. The particulate capture material can be a self-healing polymeric material oriented in a particulate control chamber 105 within the particulate capture shell. The self-healing polymeric material can be any suitable material such as, but not limited to, expanded polyurethane, expanded polyethylene, expanded polystyrene, ionomeric metal salt of an ethylene-vinyl copolymer, open cell foams of high internal phase emulsions (HIPEs), copolymers thereof, and composites thereof. In one aspect, the self-healing polymeric material is expanded polyurethane or an ionomeric metal salt. In one example, the self-healing particulate capture material 125 can be a self-healing ionomer. For example, the ionomer may comprise a metallic salt of a copolymer of an olefin, such as ethylene and a vinyl monomer having an acidic grouping thereon. In an ionomer, linkage of the polymeric chain is accomplished by ionic as well as covalent bonds. Ionomeric polymers can be effective at absorbing the kinetic energy of bullets and have been used in targets such as may be used at shooting ranges for target practice. Wood, cardboard, fiberboard and other rigid penetrable structures are often employed in shooting ranges as targets. Penetration of bullets through targets of these materials results in the removal of a portion of the target material and creates a corresponding hole in the target resulting in loss of integrity of the target. Self-healing ionomeric polymers can provide a longer useful life for a target. The use of self-healing ionomeric polymers in connection with firearms has thus been as a longer-lasting target, as opposed to a non-target device on the end of a firearm for capturing particulates after the bullet has passed through the self-healing material. A bullet passing through a sheet of ionomeric polymer will initially stretch the material and form an opening which is resealed after the bullet has passed.

An ionomeric polymer which is particularly suitable for use as the self-healing particulate capture material is sodium or zinc salt of a copolymer of ethylene and methacrylic acid. One commercially available form of this ionomeric polymer is Surlyn®, manufactured by the DuPont Corporation. While Surlyn® is manufactured in a number of different grades, the grade designation 8940 is suitable for the self-healing material. The 8940 grade material includes a sodium cation and has a nominal density of 0.95 g/cm 3. Other grades of the Surlyn® polymer, such as grade 8920 can exhibit similar properties and be usable in the particulate capture device. Different grades of materials can be used for different temperature conditions. For example, melting points, strength, toughness, melting points, freezing points, and so forth can vary between grades and particular grades may be more useful in higher or lower temperature conditions. For example Surlyn® 8020 can exhibit some better lower temperature properties than some other grades of Surlyn®.

Other ionomeric polymers with self-healing properties may also be used in the particulate capture module. For example, the ionomeric material may further include fire retardant agents, coloring agents, and so forth. As further examples of self-healing materials, Surlyn® and Affinity® EG8200, both of which are poly(ethylene) based copolymers, will self-heal upon ballistic testing at ambient temperature (~24° C.). Lexan, poly(butylene terephthalate) (PBT), and poly(butylene terepthalate)-co-poly(alkylene glycolterepthalate) (PBT-co-PAGT) polymers display an improvement in damage tolerance at elevated temperatures (>100° C.). Poly(butadiene)-graft-poly(methyl acrylate-co-acrylonitrile) (PB-g-PMA-co-PAN) also displays healing between 50° C. and 100° C. In summary, some commercially available polymers possessing instantaneous puncture self-healing functionality have been identified. React-A-Seal by Reactive Target Systems and Nucrel® are additional examples of self-healing polymeric materials.

Puncture healing in these materials can depend upon how the combination of a polymer's viscoelastic properties responds to energy input resulting from a puncture event, such as from a bullet or other projectile. Projectile penetration increases the temperature in the vicinity of the impact. Self-healing behavior can occur following the puncture and is often facilitated by increases in temperature for most self-healing materials. In the self-healing process energy can be transferred to the material during impact, both elastically and inelastically. For puncture healing to occur, the puncture event will typically produce a local melt state in the polymer material and the molten polymer material will have sufficient melt elasticity to snap back and close the hole. For example, some ballistics tests indicate that Surlyn® materials warm up to a temperature of approximately 98° C. during projectile puncture, which is approximately 3° C. higher than a melting temperature. The temperature increase produces a localized flow state and the melt elasticity for the material to snap back and seal the puncture.

While the foregoing examples relate primarily to self-healing ionomers as the self-healing particulate capture material, other variations and types of materials may be used. For example, various self-healing ionomer composites exist which may also be used in the particulate capture module. Additionally, nonionic EMAA (Ethylene-Methacrylic acid) copolymers may also be used. For example, some studies show that ionic content may not be what provides a specific stimulus for self-healing of ballistic punctures. Nucrel® is a material manufactured by the DuPont Corporation which is nonionic and which exhibits the self-healing behavior. Also, certain ballistics gels and high-density foams can also exhibit self-healing behavior. Non-limiting examples of suitable commercial materials include polyfoam target backers (e.g. from Law Enforcement Technologies and Action Target).

The thickness of the self-healing material in the particulate capture module can vary depending on a specific application. For example, different caliber bullets will have different penetration capabilities. A thicker self-healing material may be used with higher caliber projectiles to enhance particulate capture. However, increasing thickness of a self-healing material can also reduce a velocity and effective range of a projectile. Example thicknesses of self-healing materials used in the particulate capture module may typically range from a fraction of an inch up to at least a couple of inches. Specifically, although other thicknesses can be used, the thickness along the bullet path can be from about 5 mm to about 60 mm, and in some cases about 10 mm to about 30 mm.

The self-healing material may be sized and shaped as desired to suit a particular application. For example, the self-healing material may comprise a thin film or flat sheet 127 of material as in FIG. 1*b*. FIG. 1*b* also illustrates a secondary annular chamber 129 prior to the primary chamber which can be a gas chamber, baffled acoustic suppression segment, particulate dampening material, or other features. The self-healing material may also be formed into a three dimensional structure of desired shape and size, such as by vacuum forming, molding, and the like. In a specific example, the self-healing material comprises a spherically shaped unit 125 as in FIG. 1*a* having a diameter of approximately 1.5 inches. Although the self-healing material can substantially fill the open particulate capture chamber within the shell 110, this is not required. As a general guideline, the self-healing material can occupy from about 75% to about 99% by volume of the particulate capture chamber within the shell.

In some examples, the self-healing particulate capture material can include a plurality of self-healing particulate capture units formed from the self-healing particulate capture material. This plurality of self-healing particulate capture units can be arranged in series within the particulate capture shell along a central axis of the particulate capture shell defined by the inlet and the outlet. Thus, the particulate capture module can include stages for successive particulate capture defined by the positioning of the plurality of particulate capture units in the shell. As such, successive material can be formed of a common material, or can be varied. For example, a first self-healing mass can be formed of a more dense and viscous material than a second self-healing mass.

In another example, multiple modular attachments can be attached to the high energy discharge device, each having the self-healing particulate capture material therein. Thus, the staging of particulate capture can be accomplished using multiple particulate capture units in a single shell, using multiple single-unit modules in series, or using multiple particulate capture modules where at least one of the modules includes multiple particulate capture units therein.

Over time, the particulate capture material can lose resiliency and/or accumulate excessive particulates sufficient to make replacement desirable. This can be determined either by experience and setting a predetermined replacement timeline, or by examination. As such, the chamber can optionally include a removable cap to allow the polymeric material to be periodically replaced. For example, the shell 110 of the particulate capture module 100 can have a removable end cap 140 to enable insertion and removal of the self-healing particulate capture material 125. Replacing a self-healing particulate capture material can include removing the removable end cap from the particulate capture shell having the self-healing particulate capture material arranged therein. The self-healing particulate capture material can be removed from the particulate capture shell either manually or with the use of a tool. A replacement self-healing particulate capture material can be inserted into the particulate capture shell. Alternatively, in some cases, the self-healing particulate capture material can be reused after cleaning and/or treatment. For example, the polymer can be heated to near its melting point and then cooled. Further, the self-healing polymers useful life may be extended by removing the material from the enclosure and then working the polymer (i.e. mixing and kneading). This can often at least substantially return performance of the self-healing material. In either case, the removable end cap can then be replaced. Although the lifespan of the self-healing material is a function of multiple variables (i.e. composition, caliber, time delays between shots, etc), as a general rule most materials will last about 100 rounds (i.e. from about 60 rounds to about 150 rounds). Generally, higher caliber rounds will reduce the material lifespan will smaller rounds can allow extended use of the self-healing materials.

When the particulate capture shell is attached to a high energy discharge device, the particulate capture shell can optionally be detached from the high energy discharge device prior to replacement of the self-healing particulate capture material. In another example, the removable end cap can be removed while the particulate capture shell is still attached to the high energy discharge device. If the particulate capture shell is detached from the high energy discharge device for replacement of the self-healing particulate capture material, the particulate capture shell can be re-attached to the high energy discharge device with the replacement self-healing particulate capture material to enable particulate capture.

In one aspect, the particulate capture device may have substantially no moving parts during operation. This can greatly improve the useful life of the device by avoiding or reducing mechanical friction and potential for part wear and/or fatigue. In one aspect, the chamber 105 within the shell 110 includes a central chamber outlet 120 along the central axis. The inlet 115 of the shell can be in communication with a high energy outlet. In a more specific aspect, the high energy material is a bullet and the high energy outlet can be a firearm muzzle (e.g. rifle, pistol, etc).

The shell 110 can include a coupler 145, 150 for attaching to the high energy discharge device when the particulate capture module is not integrally formed with the high energy discharge device. FIG. 1*a* illustrates an example coupler with a male component 145 and female component 150 to enable coupling. FIG. 1*b* illustrates another example coupler which is threaded to enable threaded coupling of the shell to the high energy discharge device. The threaded coupler can likewise include a male component 147 and female component 152. Although the example couplers illustrated in FIGS. 1*a*-1*b* show couplers which extend outward from the shell 112, or out further than the end cap 140, at least one of the coupling mechanisms can also be configured to extend inwardly into the shell. Also, various other types of coupling mechanisms may be used to couple the particulate capture module to a high energy discharge device or other modular attachment to a high energy discharge device (i.e. suppressors, flash hiders, etc).

In another more specific example, the threaded coupler can have helical threads rotating in an opposite direction as rifling in the high energy discharge device. Having the coupler threads rotate in an opposite direction as the rifling will result in torque on the particulate capture module from the spin of the bullet which tightens the threaded coupling of the particulate capture module to the high energy discharge device. Although such rifling can vary depending on the platform, clockwise rifling could then be used with counter-clockwise threads on the threaded coupler of the particulate capture module.

In another specific example, the particulate capture module can be a modular attachment to enable selective particulate capture and/or sound suppression in the field. The ends of the particulate capture module can include an engagement or coupling mechanism to secure modules to one another and/or to a firearm when desired. The coupling device can maintain a relative position between the shell and the high energy discharge device. Non-limiting examples of suitable engagement mechanisms can include threaded engagement, recessed locking, interference fit, detent locking, and the like. The modular design can be sub-divided into additional sub-modules as desired and reassembled to provide function individually or assembled. In a more specific aspect, the coupling device includes a first coupling member having a first catch and a first alignment surface. A second coupling member can have a second catch and a second alignment surface. A resilient component can be associated with the second coupling member and can resiliently deflect upon engagement with the first catch when joining the first coupling member and the second coupling member. Engagement with the first catch can resist release of the first coupling member and the second coupling member. The first catch and the second catch can interface to maintain a relative position along a first axis and the first alignment surface and the second alignment surface interface to maintain a relative position along a second axis orthogonal to the first axis. A specific example of a particularly effective coupling mechanism is described in U.S. patent application Ser. No. 61/418,311, filed Nov. 30, 2010, entitled "Coupling Device, System, and Methods to Maintain Relative Positions Between Two Components," which is incorporated herein by reference.

The particulate capture module can optionally include one or more baffles 155 or chambers within the particulate capture shell for providing increased particulate capture functionality and/or sound reduction functionality.

In another aspect, the shell chamber can further include an annular dampening chamber 135 oriented about the central chamber and being filled with an energy absorbent material. The dampening chamber can be oriented adjacent the outer shell 110. The energy absorbent material can be any suitable acoustic impedance filter. Generally, the material can absorb and/or deflect acoustic waves back toward the bullet path. In one aspect, the energy absorbent material is a dry material. Non-limiting examples of suitable material can include powder tungsten filament, metal powder, graphite, polymer, and the like. In one aspect the material can be a powder tungsten filament or other heavy metal or metal powders (e.g. aluminum, stainless steel, carbon steels, iron, copper, tantalum, titanium, vanadium, chromium, zirconium, carbides of these, alloys of these, and the like). Although fluids could be used (e.g. oil, water etc.) these are generally not needed and can be conveniently omitted without loss of performance.

Figure 1C:
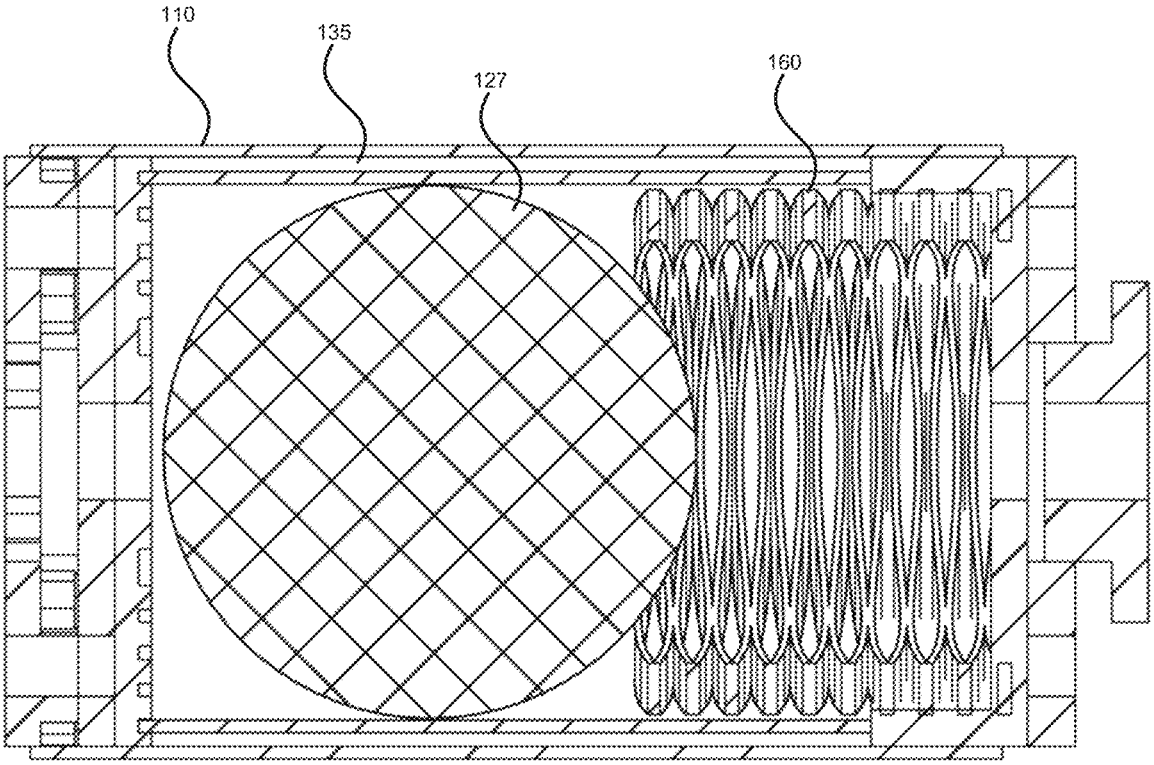

FIG. 1*c* illustrates yet another example embodiment of a particulate capture module. The particulate capture module of FIG. 1*c* includes a shell 110, a particulate capture material 127, and an annular dampening chamber 135 as has been previously described. The annular dampening chamber can optionally include a particulate material (e.g. tungsten or other metal powder). The particulate capture module additionally includes a resilient member 160. The resilient member can be positioned between the particulate capture member and an outlet of the particulate capture module. The resilient member can be in the form of a spring, a web, a mesh, or any other suitable structure for cushioning the particulate capture material from impact of the high energy material. This can additionally reduce ballistic impact on a bullet passing therethrough.

Figure 2:
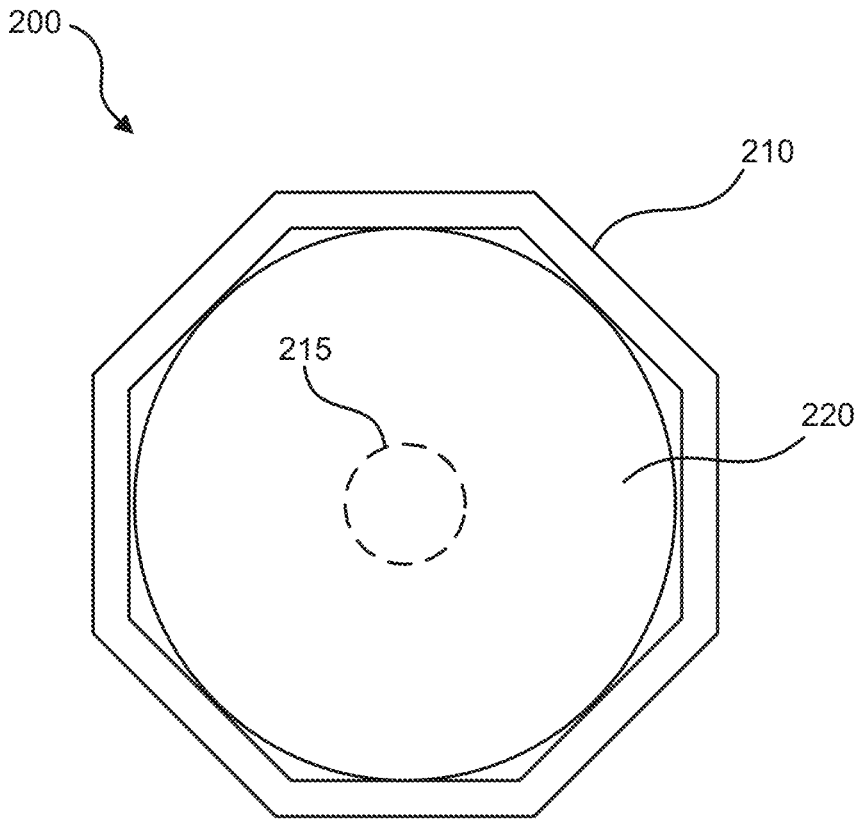
FIG. 2 is a cross-sectional end view of a particulate capture module in accordance with an example of the present technology.

The outer shell can be generally tubular and have any suitable cross-section shape. In one aspect illustrated in FIG. 2, the outer shell 210 of a particulate capture module 200 has an octagonal cross-section. The outer shell can optionally have a circular or polygonal cross-section or any other desired shape (e.g. 5, 6, 7, 9 or 10 sides). Likewise, the inner portion of the shell can have any of a number of different shapes. The shape of the inner portion of the shell may be the same or different than the outer shape of the shell. In one aspect, an inner shell shape can correspond to a shape of the particulate capture material to be inserted into the shell. FIG. 2 also illustrates an inlet or outlet 215 for the high energy material to pass through the particulate capture module and an inner shell shape which corresponds to the outer shell shape, but which is different from a shape of the particulate capture material 220.

The devices described can generally perform well for a large number of cycles, periodic optional cleaning can remove film, debris or other material which collects within the device. Non-limiting examples of suitable cleaning protocols can include sonication, solvent immersion, disassembly, and high pressure air. Although specific particulate capture performance can vary depending on the specific configuration and options included, these designs have shown significant reduction in particulate expulsion from high energy devices. The resulting devices can dramatically suppress particulate expulsion typically associated with discharge of high energy materials while providing for minimal maintenance and high cycle life.

Figure 3:
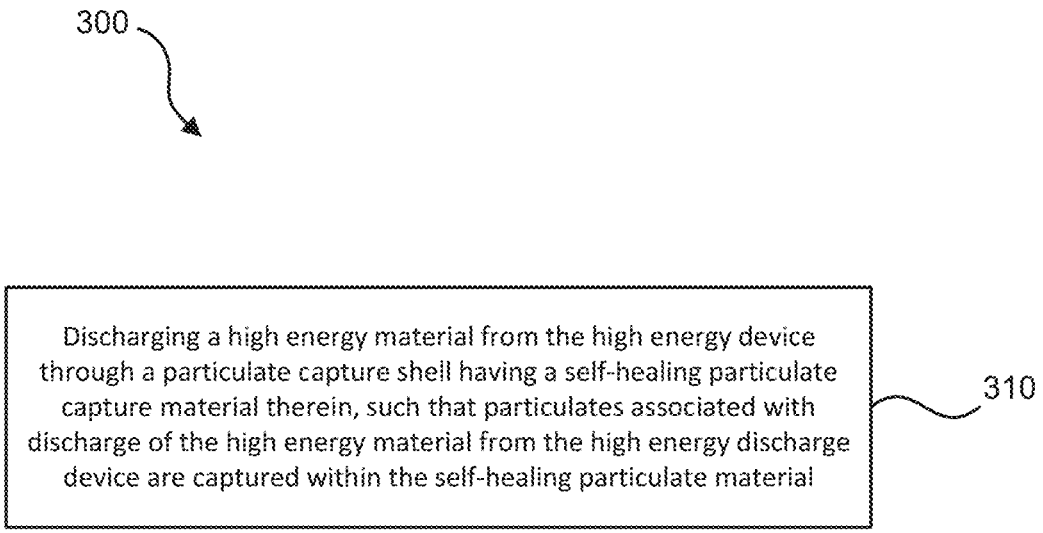
FIG. 3 is a flow diagram of a method for capturing particulates from a high energy discharge device in accordance with an example of the present technology.

A method 300 is shown in FIG. 3 for capturing particulates from a high energy discharge device in accordance with an example. The method can include discharging 310 a high energy material from the high energy device through a particulate capture shell having a self-healing particulate capture material therein. Particulates associated with discharge of the high energy material from the high energy discharge device can be captured within the self-healing particulate material.

As described above, discharging the high energy material can also tighten a threaded connection between the particulate capture shell and the high energy device as a result of a spin of the high energy material and a direction of threads of the threaded connection. Also, discharging the high energy material from the high energy device may further comprise discharging the high energy material through the particulate capture shell having a plurality of self-healing particulate capture units comprised of the self-healing particulate capture material. The method can also include replacing the self-healing particulate capture material after a number of discharges of the high energy material from the high energy device.

The particulate capture module can be formed permanently and integrally with a high energy discharge device or can be a detachable module. In one aspect, the particulate capture module can be an accessory to a firearm and can be sold as a firearm kit. The kit can include the particulate capture shell, a self-healing polymer, and instructions for use. In another example, a firearm kit may be a replacement kit without the particulate capture shell. Thus, the kit may include the self-healing polymer and instructions for replacing or inserting the self-healing polymer into the particulate capture shell.

Figure 4:
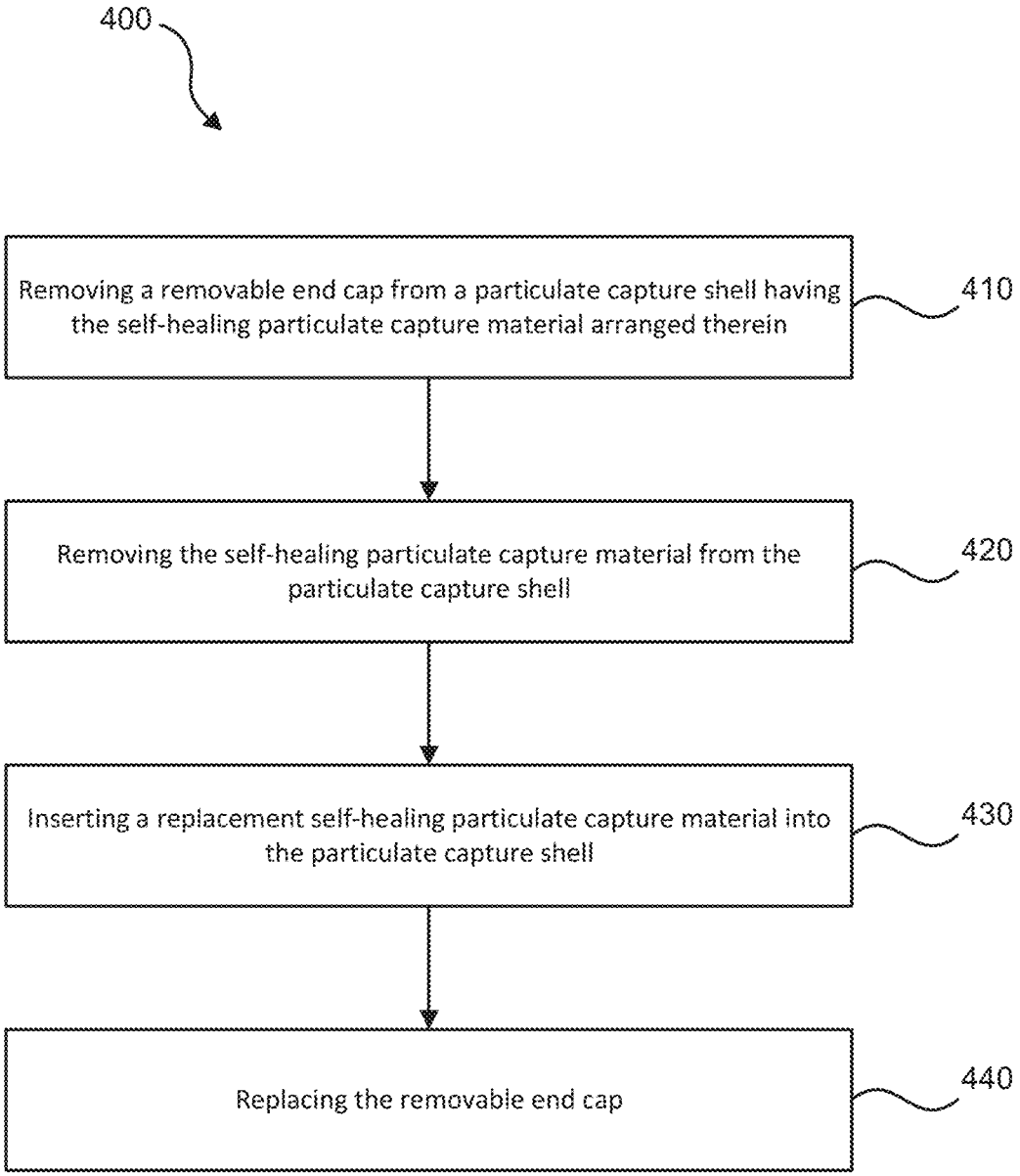
FIG. 4 is a flow diagram of a method of replacing a self-healing particulate capture material in accordance with an example of the present technology.

FIG. 4 illustrates a flow diagram of a method 400 for replacing a self-healing particulate capture material. The method can include removing 410 the removable end cap from the particulate capture shell having the self-healing particulate capture material arranged therein. The self-healing particulate capture material can be removed 420 from the particulate capture shell either manually or with the use of a tool. A replacement self-healing particulate capture material can be inserted 430 into the particulate capture shell. The removable end cap can then be replaced 440.

Although the devices described are exemplified in terms of firearms, other applications can also benefit from these configurations. For example, high velocity/high temperature gases, projectiles, heat or sound energy can be suppressed using these devices. By adjusting the chamber configurations (e.g. number or shapes of tubes, deflectors, windings, etc) the back pressure can be tuned for a particular application. Most often, the device also does not adversely affect performance of the host mechanism to which it is attached.

Energy Capture and Control

An energy capture and control device can comprise a central chamber oriented along a central axis within an outer shell. The central chamber can have an inlet configured to receive a high energy material from a high energy outlet. An off axis chamber can be oriented within the outer shell in fluid communication with the central chamber. The off axis chamber can have a fluid outlet.

Figure 5A:
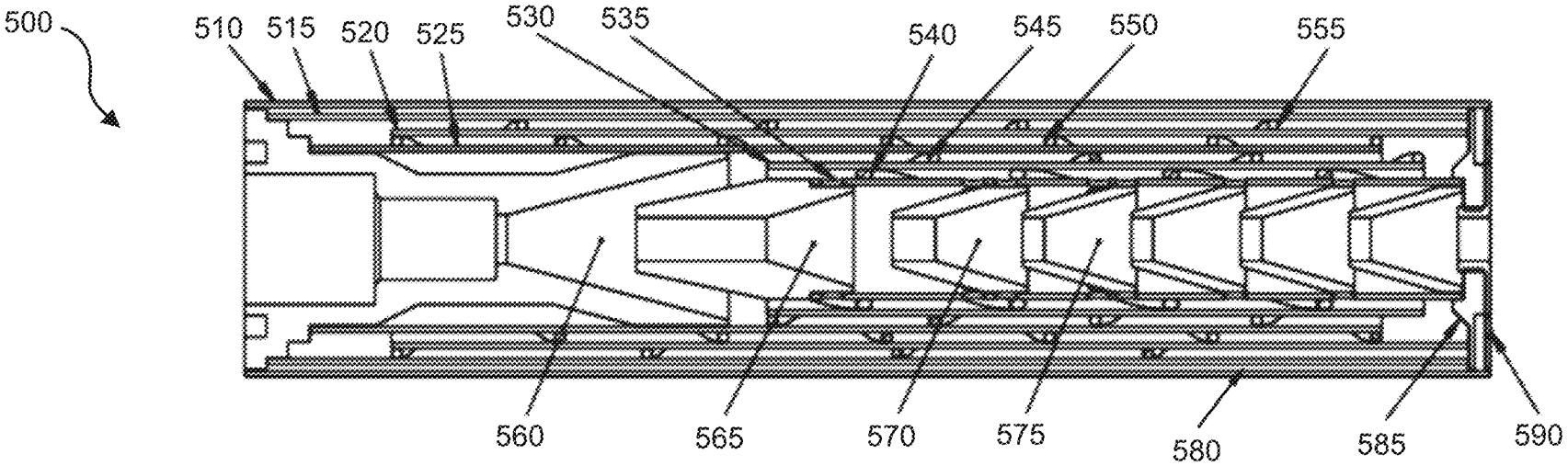
FIG. 5*a* is a cross-sectional side view of a device having multiple concentric tubes, a helical wall, and series of deflectors in accordance with an example of the present technology.

Further, the off axis chamber may have multiple internal walls configured to produce an axially serpentine fluid pathway which dissipates energy transferred from the high energy material. As illustrated in FIG. 5*a*, the central chamber can further comprise a locking block 560 oriented at the inlet. The locking block 560 can have an engagement surface configured to attach to the high energy outlet and a hollow interior along the central axis, said hollow interior having a reducing throat portion and a flared outlet. FIG. 7*a* through 8*b* illustrate two optional configurations for a locking block 560, 562.

In another aspect, the central chamber can further comprise a plurality of deflectors 565, 570, 575 oriented in series along the central axis. A variety of specific contours and deflector shapes can be used. In one aspect, the plurality of deflectors can be frustoconical having a hollow interior along the central axis and each having a flared exit portion as illustrated in FIG. 5*a* and FIGS. 9*a*-11*b*. The embodiment shown in FIG. 5*a* illustrate a plurality of deflectors which include a primary deflector 565, a secondary deflector 570, and at least one tertiary deflector 757, e.g. the at least one tertiary deflector can often include four deflectors. The tertiary deflectors are not required but can be at least partially engaged within the flared exit portion of an adjacent deflector. In another optional aspect, the plurality of deflectors can span substantially the entire central axis along the central chamber.

Figure 5B:
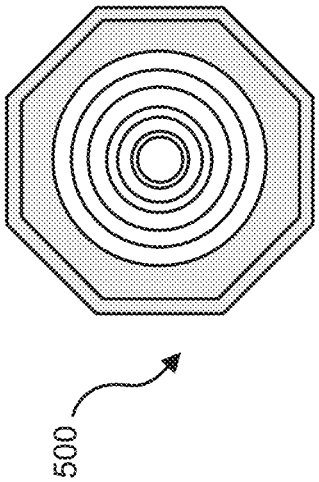
FIG. 5*b* is a cross-sectional end view of the device of FIG. 5*a;*
Figure 6:
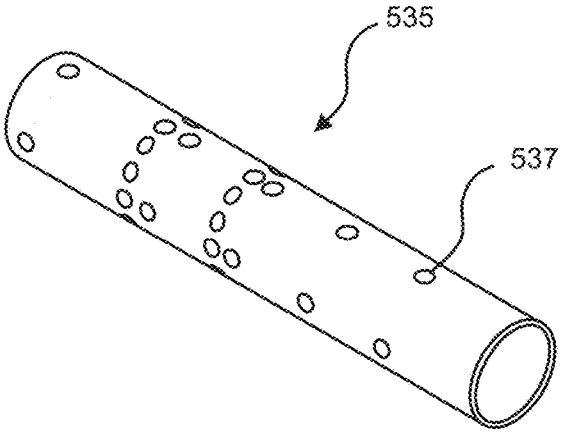
FIG. 6 is a perspective view of an innermost tube having apertures to allow fluids to flow from the central chamber into the off axis chamber in accordance with an example of the present technology.
Figure 7A:
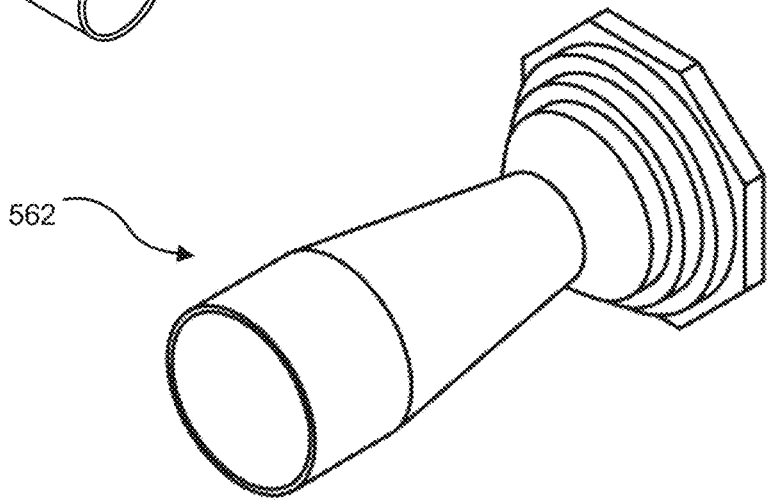
FIG. 7*a* is a perspective view of a locking block having a tapered throat portion in accordance with an example of the present technology.
Figure 7B:
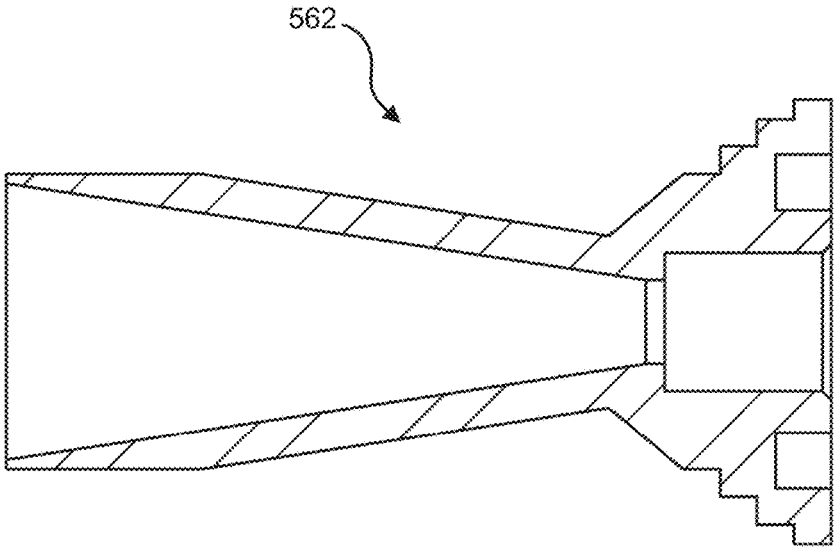
FIG. 7*b* is a cross-sectional side view of the locking block of FIG. 7*a;*
Figure 8A:
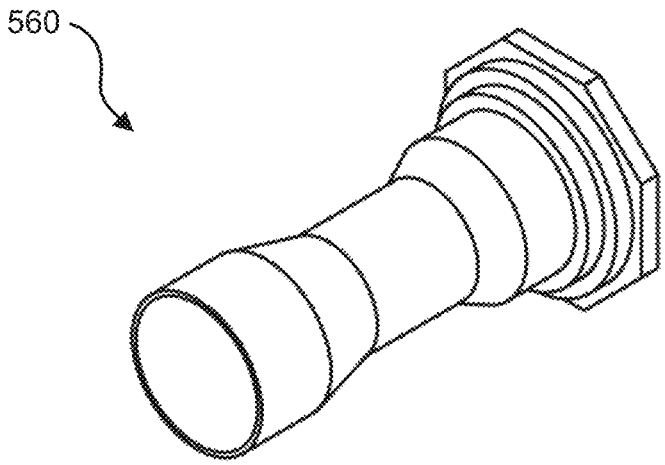
FIG. 8*a* is a perspective view of a locking block having a tapered throat portion with an intermediate throat portion in accordance with an example of the present technology.
Figure 8B:
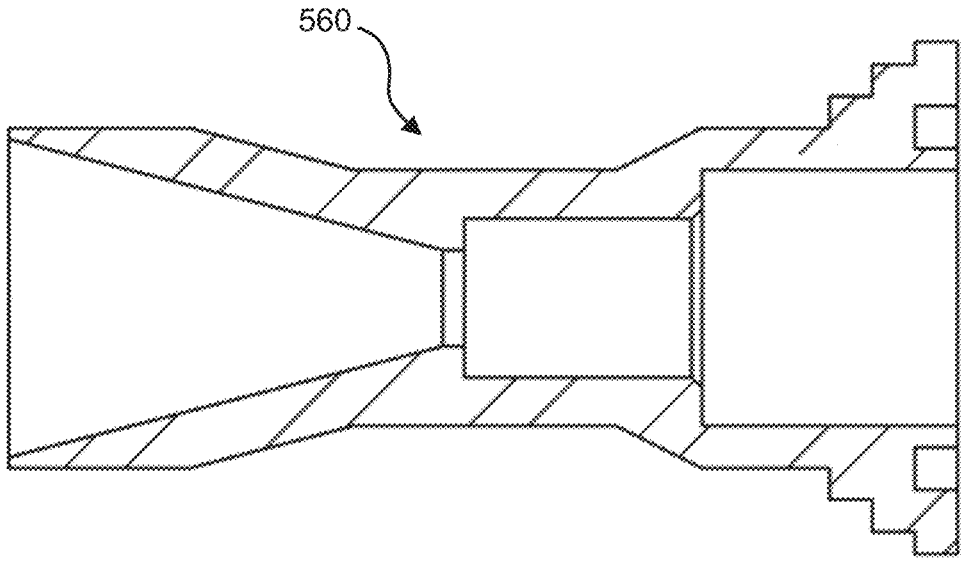
FIG. 8*b* is a cross-sectional side view of the locking block of FIG. 8*a;*
Figure 9A:
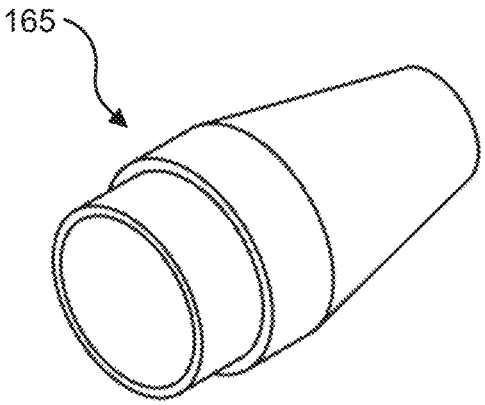
FIG. 9*a* is a perspective view of a primary chamber in accordance with an example of the present technology.
Figure 9B:
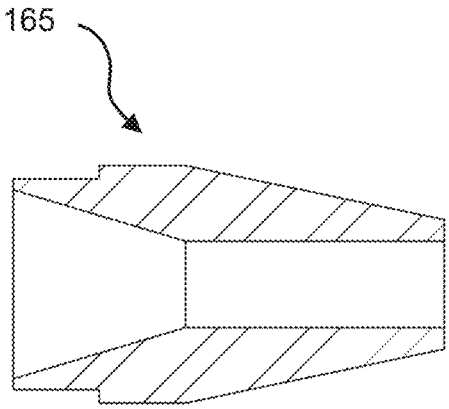
FIG. 9*b* is a cross-sectional side view of the primary chamber of FIG. 9*a;*
Figure 10A:
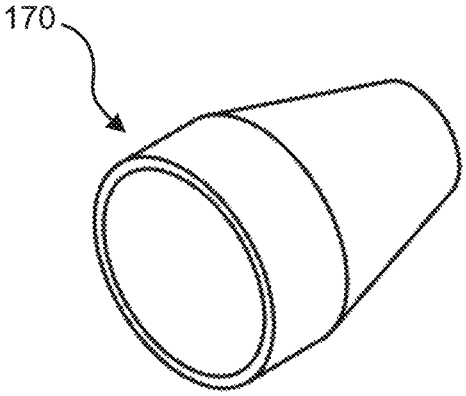
FIG. 10*a* is a perspective view of a primary chamber in accordance with an example of the present technology.
Figure 10B:
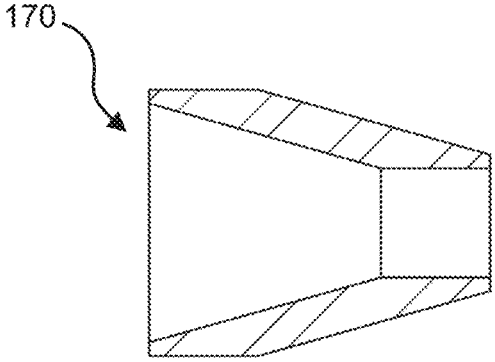
FIG. 10*b* is a cross-sectional side view of the primary chamber of FIG. 10*a;*
Figure 11A:
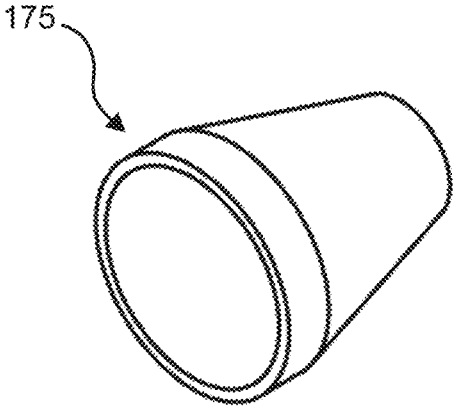
FIG. 11*a* is a perspective view of a primary chamber in accordance with an example of the present technology.
Figure 11B:
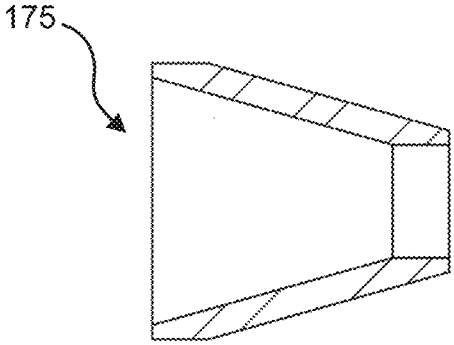
FIG. 11*b* is a cross-sectional side view of the primary chamber of FIG. 11*a;*

The multiple internal walls can provide an increased volume for fluid expansion and increased acoustic absorbent path length. Thus, at least one annular space can be formed within the off axis chamber. In one aspect, the multiple internal walls are formed by multiple concentric tubes 515, 520, 525, 530, 535 having progressively larger diameters so as to form annular spaces between each adjacent tube, as illustrated in FIG. 5*a* and FIG. 5*b*. The axially serpentine fluid pathway can be formed using a variety of wall configurations. In one aspect, the concentric tubes can have ends offset from an adjacent tube so as to produce a serpentine fluid annular pathway. The multiple concentric tubes can include an innermost tube which includes orifices oriented to allow fluid to pass from the central chamber into a first annular space adjacent the innermost tube and through the annular spaces of progressively larger diameter. One configuration of an innermost tube 535 is shown in FIG. 6 with orifices 137. Orifices can be varied in location, size and number for individual designs. In one aspect, the holes can be oriented adjacent a contact point between a deflector and an inner wall of the innermost tube.

Another optional aspect of the device is to include a helical wall oriented within at least one of the annular spaces to direct fluids along a helical path within the at least one annular space. Although not all of the annular spaces need a helical wall, in one aspect all of the annular spaces which define the fluid pathway include a helical wall. FIGS. 5*a* and 14*a*-17 illustrate a helical rod having a spring-like shape. FIGS. 14*a*-17 illustrate helical walls having a square cross-section. However, any suitable cross-section can be used (e.g. quadrilateral cross-section or a circular cross-section, e.g. FIG. 5*a*). As illustrated in FIG. 5*a*, helical walls can providing helical paths of alternating direction. For example, helical walls 540 and 550 rotate clockwise, while helical walls 545 and 555 rotate counter-clockwise to provide alternating helical direction. As illustrated in FIGS. 14*b*-16 the helical walls 540, 541, 542, 543 can have varying winding ratios (i.e. windings:diameter). This winding ratio can be varied to optimize performance of the device for particular applications based on a number of variables (e.g. caliber, back pressure, etc.). The helical walls can be optionally replaceable so as to provide an adjustable tuning or may be fixed. This ratio can also be changed in order to control and/or adjust the energy transfer velocity and subsequent back pressure returned to the high energy outlet. This innovation is a completely new approach and resolves or mitigates adverse effects that traditional sound suppressors have on their host weapon. For example, 75% loss of expected life span of the weapon due to excessive PSI, rate of fire increases, excessive fouling and carbon buildup, debris returning to the operators face via the chamber of the barrel, unreliability due to combinations of these issues. These drawbacks can be largely eliminated or substantially reduced using the configurations described herein.

Generally, a higher rate of twist provides a greater path length for fluids along the fluid pathway to the chamber outlet. Although other ratios can be suitable, in one aspect, the helical wall has a winding ratio of about 3:1 to about 8:1. In one aspect, the device can include five multiple concentric tubes forming the annular spaces although other numbers of concentric tubes can be suitable. For example, pistol suppressors can sometimes utilize fewer chambers while high caliber rifles can utilize more chambers to achieve desirable sound suppression.

In another aspect, the off axis chamber can further include an annular dampening chamber oriented about the central chamber and being filled with an energy absorbent material. The dampening chamber 580 can be oriented adjacent the outer shell 510 as illustrated in FIG. 5*a*. The energy absorbent material can be any suitable acoustic impedance filter. Generally, the material can absorb and/or deflect acoustic waves back toward the bullet path. In one aspect, the energy absorbent material is a dry material. Non-limiting examples of suitable material can include powder tungsten filament, metal powder, graphite, polymer, and the like. In one aspect the material can be a powder tungsten filament or other heavy metal or metal powders (e.g. aluminum, stainless steel, carbon steels, iron, copper, tantalum, titanium, vanadium, chromium, zirconium, carbides of these, alloys of these, and the like). Although fluids could be used (e.g. oil, water etc.) these are generally not needed and can be conveniently omitted without loss of performance. This dampening chamber can be used in connection with or without the axially serpentine fluid pathway or the plurality of deflectors. The energy absorbent material can also be optionally introduced into other chambers within the device. For example, the energy absorbent material can be particularly beneficial when placed in one or more annular spaces intermediate between the central axis and the outer shell. In one aspect such as those shown in FIG. 5*a* a tapered annular space exists between the locking block throat and the adjacent tube (i.e. tube 515).

Figure 12A:
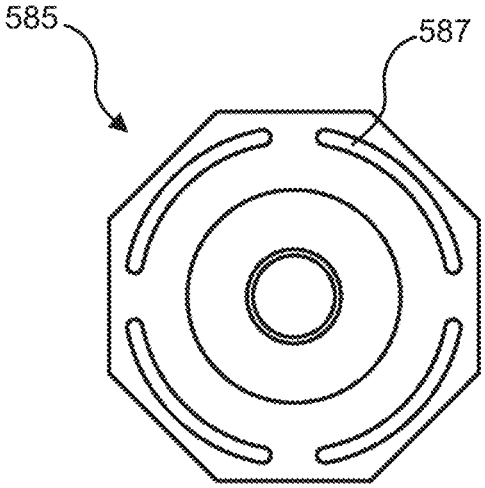
FIG. 12*a* is an end view of a tube cap in accordance with an example of the present technology.
Figure 12B:
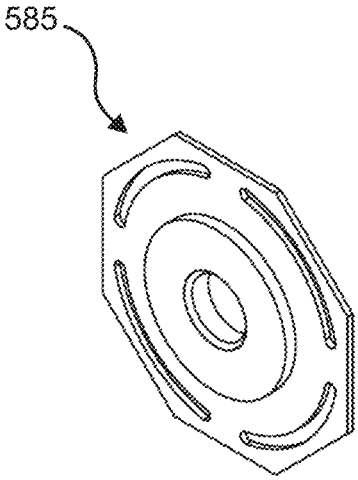
FIG. 12*b* is a perspective view of the tube cap of FIG. 12*a;*
Figure 13A:
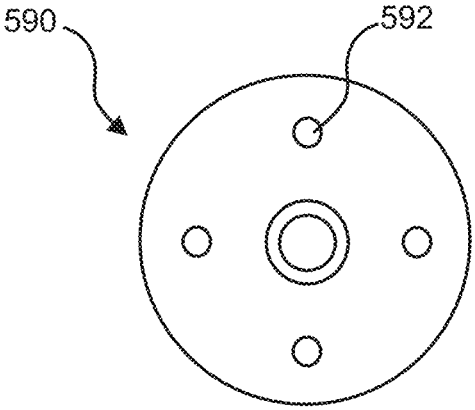
FIG. 13*a* is an end view of an end cap in accordance with an example of the present technology.
Figure 13B:
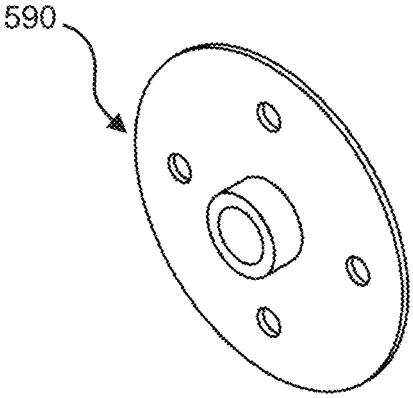
FIG. 13*b* is a perspective view of the end cap of FIG. 13*a;*
Figure 14A:
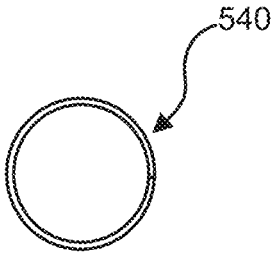
FIG. 14*a* is an end view of a helical wall in accordance with an example of the present technology.
Figure 14B:
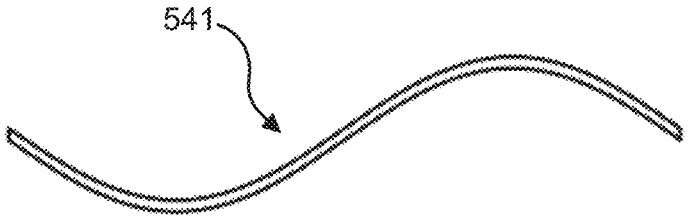
FIG. 14*b* is a side view of a single revolution helical wall in accordance with an example of the present technology.
Figure 15:
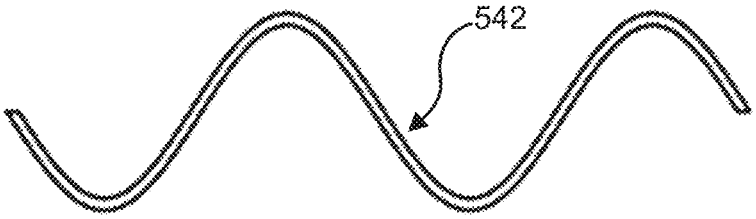
FIG. 15 is a side view of a two revolution helical wall in accordance with an example of the present technology.
Figure 16:
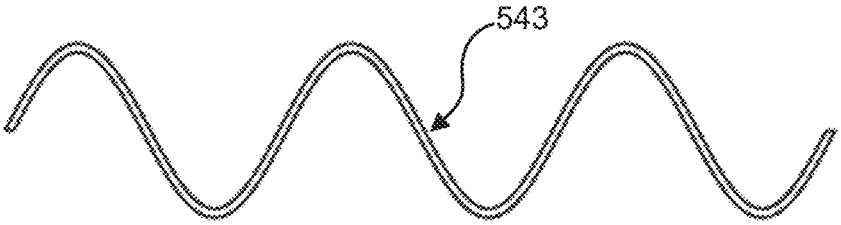
FIG. 16 is a side view of a three revolution helical wall in accordance with an example of the present technology.
Figure 17:
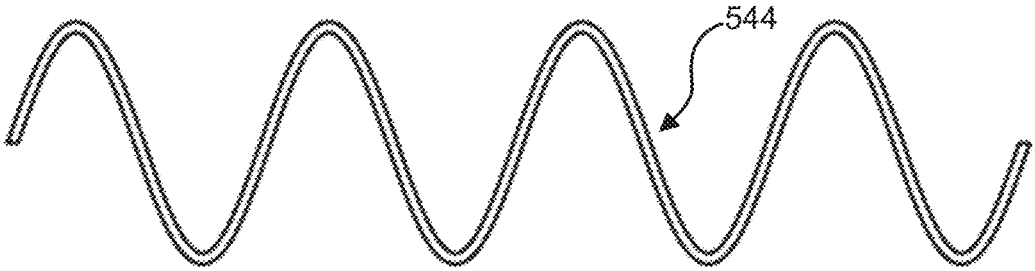
FIG. 17 is a side view of a four revolution helical wall in accordance with an example of the present technology.

The outer shell can be generally tubular and have any suitable cross-section shape. In one aspect, the outer shell has an octagonal cross-section as shown in FIG. 5*b*. However, the outer shell can optionally have a circular cross-section or any other desired shape (e.g. 5, 6, 7, 9 or 10 sides). Optionally, the outer shell can include an end cap assembly 590 at an outlet end of the central chamber and which allows fluid to escape from the off axis chamber. The end cap assembly shown in FIG. 5*a* (and FIG. 12*a*-13*b*) shows an assembly where the outlet slits 587 along the tube cap 585 (FIGS. 12*a* and 12*b*) and the exit apertures 592 of the end cap 590 (FIGS. 13*a* and 13*b*) are offset to prevent an unobstructed exit of fluids from the chamber.

In some applications a modular system can be desirable to allow for adjustable acoustic suppression in the field. For example, the device can be modularized along the central axis to form at least two detachable portions. In one aspect, the chamber can be divided between the secondary and tertiary deflectors of FIG. 5*a* and capped at the junction on each corresponding end. The ends can include an engagement mechanism to secure the modules together when desired. Non-limiting examples of suitable engagement mechanisms can include threaded engagement, recessed locking, interference fit, detent locking, and the like. The modular design can be sub-divided into additional sub-modules as desired and reassembled to provide function individually or assembled.

In another aspect, the device has substantially no moving parts during operation. This can greatly improve the useful life of the device by avoiding or reducing mechanical friction and potential for part wear and/or fatigue. In one aspect, the central chamber includes a central chamber outlet along the central axis and the high energy material is a bullet. The high energy outlet in this case can be a firearm muzzle (e.g. rifle, pistol, etc).

Although the parts of the device can be formed of any suitable material, the central chamber and off axis chamber can be formed substantially of titanium. Non-limiting examples of other suitable materials can include high impact polymers, stainless steels, aluminum, molybdenum, refractory metals, super alloys, aircraft alloys, carbon steels, composites thereof, and the like. One or more of the individual components can further include optional coatings such as, but not limited to, diamond coatings, diamond-like carbon coatings, molybdenum, tungsten, tantalum, and the like can also be used. These components can be molded, machined, deposited or formed in any suitable manner. Currently, machining can be particularly desirable but is not required.

Figure 18:
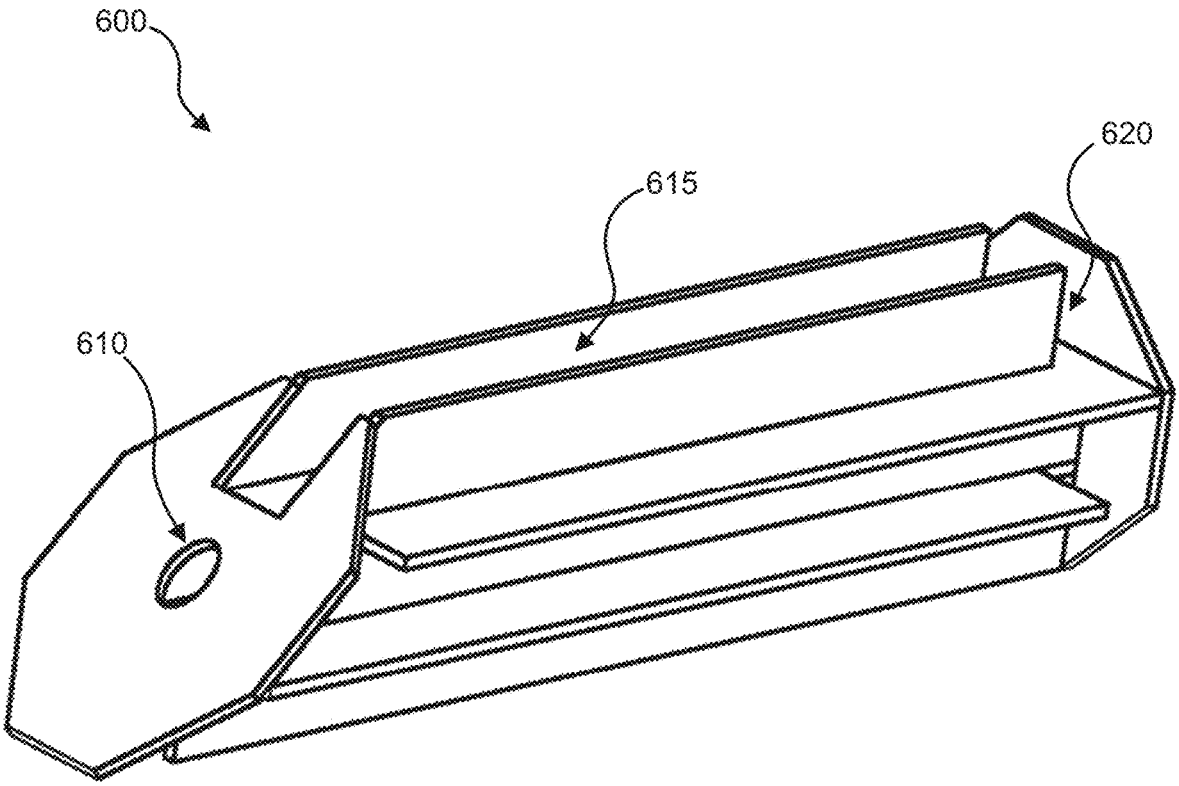
FIG. 18 is a perspective view of a device within an outer shell having longitudinal chambers which are each off set from the central axis in accordance with an example of the present technology.

FIG. 18 illustrates another optional configuration for an energy capture and control device 600 having an inlet 610 where the multiple internal walls form a plurality of longitudinal chambers and are each off set from the central axis and fluidly connected to from the axially serpentine fluid pathway. In this case, the longitudinal chambers include a first primary chamber 615 which splits the fluid flow into two paths at the end 620. The two paths are axially serpentine along opposing sides and then recombine at a lower common chamber which can then direct fluids to a chamber exit.

The devices can generally perform well for a large number of cycles, periodic optional cleaning can remove film, debris or other material which collects within the device. Non-limiting examples of suitable cleaning protocols can include sonication, solvent immersion, disassembly, and high pressure air. Although specific acoustic suppression performance can vary depending on the specific configuration and options included, these designs have shown up to 15% sound reduction. The resulting devices can dramatically suppress acoustic impact of high energy materials with minimal maintenance and high cycle life.

Although the devices described are exemplified in terms of firearms, other applications can also benefit from these configurations. For example, high velocity/high temperature gases, projectiles, heat or sound energy can be suppressed using these devices. By adjusting the chamber configurations (e.g. number or shapes of tubes, deflectors, windings, etc) the back pressure can be tuned for a particular application. Most often, the device also does not adversely affect performance of the host mechanism to which it is attached.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

What is claimed is:

1. An energy capture and control device, comprising:

a) a central chamber oriented along a central axis within an outer shell, said central chamber having an inlet configured to receive a bullet from a firearm muzzle, and a central chamber outlet along the central axis; and b) an off axis chamber oriented within the outer shell in fluid communication with the central chamber and a fluid outlet to allow fluid to escape from the off axis chamber separate from the central chamber, and wherein the fluid outlet is oriented at a forward end of the outer shell.

2. The device of claim 1, wherein the central chamber further comprises a locking block oriented at the inlet, said locking block having an engagement surface configured to attach to the high energy outlet and a hollow interior along the central axis, said hollow interior having a reducing throat portion and a flared outlet.

3. The device of claim 1, wherein the central chamber further comprises a plurality of deflectors oriented in series along the central axis.

4. The device of claim 3, wherein the plurality of deflectors are frustoconical having a hollow interior along the central axis and each having a flared exit portion.

5. The device of claim 3, wherein the plurality of deflectors include a primary deflector, a secondary deflector, and at least one tertiary deflector.

6. The device of claim 5, wherein the plurality of deflectors are at least partially engaged within the flared exit portion of an adjacent deflector.

7. The device of claim 3, wherein the plurality of deflectors span substantially the entire central axis along the central chamber.

8. The device of claim 1, wherein the off axis chamber includes multiple internal walls configured to produce an axially serpentine fluid pathway which dissipates energy transferred from the high energy material.

9. The device of claim 8, wherein the multiple internal walls are formed by multiple concentric tubes having progressively larger diameters so as to form annular spaces between each adjacent tube, and having alternating ends offset so as to produce an axially serpentine fluid annular pathway.

10. The device of claim 9, wherein the multiple concentric tubes include an innermost tube which includes orifices oriented to allow fluid to pass from the central chamber into a first annular space adjacent the innermost tube and through the annular spaces of progressively larger diameter.

11. The device of claim 9, wherein the annular spaces further include a helical wall oriented within at least one of the annular spaces to direct fluids along a helical path within the at least one annular space.

12. The device of claim 11, wherein the helical wall has a winding ratio (windings:diameter) of about 3:1 to about 8:1.

13. The device of claim 11, wherein all of the annular spaces include a corresponding helical wall.

14. The device of claim 8, wherein the multiple internal walls form a plurality of longitudinal chambers which are each off set from the central axis and fluidly connected to from the axially serpentine fluid pathway.

15. The device of claim 1, wherein the off axis chamber includes a helical wall oriented within the off axis chamber to direct fluids along a helical path.

16. The device of claim 15, further comprising at least one additional helical wall configured to provide an alternating rotational direction.

17. The device of claim 1, wherein the off axis chamber further includes an annular dampening chamber oriented about the central chamber and being filled with an energy absorbent material.

18. The device of claim 17, wherein the dampening chamber is oriented adjacent the outer shell.

19. The device of claim 1, wherein the outer shell includes an end cap assembly at an outlet end of the central chamber and the end cap also includes the fluid outlet which allows fluid to escape from the off axis chamber.

20. The device of claim 1, wherein the device is modularized along the central axis to form at least two detachable portions.

21. The device of claim 20, wherein one of the at least two detachable portions is a particulate modular attachment having a particulate inlet and a module outlet defining a particulate control chamber, said attachment configured to attach to the fluid outlet and remove particulates.

22. The device of claim 21, wherein the particulate modular attachment includes a self-healing polymeric material oriented in the particulate control chamber.

23. The device of claim 1, wherein the device has substantially no moving parts during operation.

24. The device of claim 1, wherein the shell further comprises a threaded coupler to enable threaded coupling of the shell to the firearm, wherein the threaded coupler comprises helical threads rotating in an opposite direction as rifling in the firearm.

* * * * *